United States Patent [19]

Weber

[11] 4,319,544

[45] Mar. 16, 1982

[54] DIGITALLY SYNTHESIZED DYNAMIC BIAS METHOD AND APPARATUS FOR TONING CONTROL IN DEVELOPING LATENT ELECTROPHOTOGRAPHIC IMAGES

[75] Inventor: Harold J. Weber, Sherborn, Mass.

[73] Assignee: Coulter Systems Corporation, Bedford, Mass.

[21] Appl. No.: 209,472

[22] Filed: Nov. 24, 1980

[51] Int. Cl.[3] ..... G03G 15/10

[52] U.S. Cl. ..... 118/647; 118/668; 118/662; 430/103; 430/35; 430/902; 355/10; 355/14 C; 355/14 D; 430/117

[58] Field of Search ..... 118/668, 662, 647; 430/902, 35, 103, 117; 355/14 C, 14 D, 14 CH, 10

[56] References Cited

U.S. PATENT DOCUMENTS 4,215,930 8/1980 Mizakawa et al. ..... 118/668 X 4,247,195 1/1981 Okamoto et al. ..... 355/14 D

*Primary Examiner*—John D. Welsh

[57] ABSTRACT

In an electrophotographic image forming process, a method and apparatus for providing an electric toning bias wherein the instantaneous electric potential value of the bias is changed with time in proportion to the natural decay of the resident electric charge inherent in the photoconductor comprising the essence of the electrophotographic medium.

26 Claims, 6 Drawing Figures

DIGITALLY SYNTHESIZED DYNAMIC BIAS METHOD AND APPARATUS FOR TONING CONTROL IN DEVELOPING LATENT ELECTROPHOTOGRAPHIC IMAGES

SUMMARY OF THE INVENTION

In electrophotographic imagery, at least three operational steps are involved:

a. charge
b. expose, and
c. tone

During the "charge" step, general practice provides for the introduction of an electric corona, ion-rich field proximate with the photoconductive surface of the selected electrophotographic medium. The resulting current flow produces an accumulation of electric charge in the electrochargeable surface of the medium. After a finite time lapse, charging action is terminated, whereupon an integratively accumulated resident charge will remain, the potential value of which is intrinsic with the elements comprising the electrochargeable surface, in a manner not unlike that of a charged electric capacitor. In any real photoconductor surface having less than ideal isolation of the charge bearing elements, once charge delivery is stopped, a natural decay or leak-off of accumulated resident charge commences. This is popularly referred to as the "dark decay," because, since the usual medium is necessarily light sensitive in order to provide any useful function, the natural decay is that of a slow, quasi-exponential decay wrought through intrinsic natural losses in the photoconductor medium, and not through the action of an external stimuli, such as light.

Therefore, when the "expose" step occurs, the natural decay is reinforced by a photoconductively introduced charge reduction proportional to the amount of light energy (if any) reaching each finite element comprising the medium surface. The rate of natural decay is, however, about constant and the light introduced change in instantaneous charge value merely serves to decrease the momentary absolute charge value, but have no substantial effect on its continuing natural decay rate.

When the exposed, albeit regionally charged, electrostatic image enters the "tone" step, a finite period of time is permitted during which the toner is allowed to be thoroughly captured by the effective electric field extensions between the toner medium and the latent electrostatic image. During this time period, the intrinsic natural decay of the yet charged regions of the photoconductor continue to decay at a predictable rate. In effect, if the toning period is lengthy, or conversely if the natural, or dark decay characteristic is moderately rapid, considerable change occurs in the instantaneous charge accommodated by each finite element comprising the photoconductor.

In the usual toning operation, a toning agent is flooded over the photoconductor while confined between the photoconductor surface and a closely spaced electrode which has an electrical potential applied. This is the toning bias, a supplementary electric field which serves to enhance the electric migration of the toning particles to best effect. The toning in this manner is well known and is described with detail in U.S. Pat. No. 4,076,406 "Method of and Apparatus for Toning Electrophotographic Film." In this earlier type of toning arrangement, the natural decay of charge intrinsic to the photoconductor is ignored and a median bias value is predetermined which gives satisfactory toning.

The instant invention improves on this use of a median bias value, allowing for more precise toning control. Instead, a dynamic bias value is produced. This dynamic bias appears as an electric potential on the bias electrode, e.g. toning plate, which is controlled to change in conformal electric value with the natural change in the photoconductor charge brought by elapsing time.

The natural charge decay of the usual photoconductor is about exponential with time, very nearly approaching the decay curve of a capacitor shunted by a high value of resistance. Therefore, in one form, the discharge of a capacitor is provided as a signal source which is amplified and coupled with the toning bias electrode.

Further teaching now shows how a natural decay curve may be synthesized digitally to produce a change of toning electrode bias potential which varies in distinct, albeit minute, steps with elapsing time. Some advantage is offered hereby in that the generated function may describe a curve having a character other than exponential, including even small permutations at certain levels, when the overall effect of the toning medium, electrode configuration, and photoconductor natural decay cry for other than a direct relationship, i.e., the tracking of the dynamic bias becomes desirably non-linear in an irregular sense in order to achieve optimum results.

Therefore, it is the purpose of the invention to teach the generation of a dynamic, electrically variant, toning bias which correlates with additional natural charge decay in a photoconductor during the toning step time lapse.

Yet another purpose of the invention is to show apparatus for producing a change in electric toning bias which varies in proportion to the continuing natural charge decay intrinsic in a photoconductor charge during the toning step time lapse.

Still another purpose of the invention is to provide a method teaching the very use of a dynamic toning bias which substantially changes with time in proportion to minute changes in the latent electrostatic image overall charge value wrought by intrinsic photoconductor natural charge decay.

The invention also shows means employing the discharge of a capacitor by a resistive path to generate a function which is amplified to provide a dynamic bias having about the same instantaneous value and rate of change to track the natural change decay of a latent image bearing electrophotographic medium.

Further shown by the invention is means for synthesizing, in a generally step-like manner, a changing potential electric value which serves as a dynamic bias, whereby the step changes with time are scaled to the time related charge decay of the photoconductor.

The invention continues to show how the resident charge value determined at the start and completion of a preceding toning time period serves to establish the bounds for the maximum and minimum decay slope values of the instantly provided dynamic bias range.

DESCRIPTION OF DRAWINGS

Four sheets of drawings including six figures serve to describe the invention.

DESCRIPTION OF THE INVENTION

Figure 1:
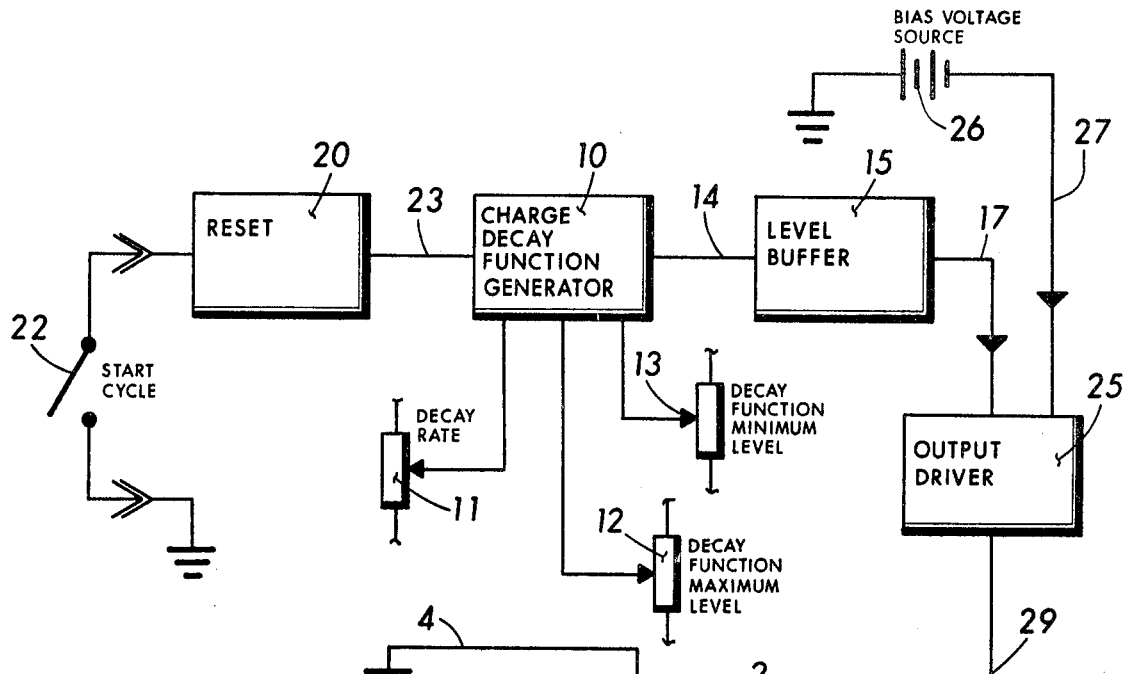
FIG. 1 The essence of the invention, including an analog rate-of-change function generator is shown.

The gist of the invention appears in FIG. 1. Central to the operation is a charge decay function generator 10. It is the purpose of this element to produce an electric signal which changes in value and with time in proportion to the change, e.g. decay, of the electric charge impressed upon the electrophotographic medium 2 surface. This function is, broadly stated, about exponential in function Provision is shown for adjusting the decay rate 11, or slope; the decay function maximum level 12, or initial electric value; and the decay function minimum level 13, or the electric value remaining after a finite, predetermined time lapse. The combination of these factors produces a changing electric value having predetermined waveform character from the generator or line 14, coupled with a level buffer 15 which adapts the rate changing signal into a waveform having an electric value and polarity suited for application with the task at hand. This level adapted signal couples 17 with the output driver 25. The driver effectively modulates the usual d.c. bias voltage source 26 value coupled 27 thereto. This controlled bias level is coupled 29 through a current limiting resistor 6 with the usual bias plate 1. The prudent artisian will recognize the arrangement of the bias plate 1, together with the working surface of an electrophotographic medium 2 as typical of ordinary image toning practice, wherein a liquid or other suitable toning agent 3 is dispersed therebetween. The dynamic bias function appears across bypass capacitor 7 and clamp diode 8, as coupled with the bias plate 1. The arrangement is also shown to include a reset function 20, which, when initiated by the "start cycle" switch 22, acts to initialize the generator 10 electrical parameters.

Figure 2:
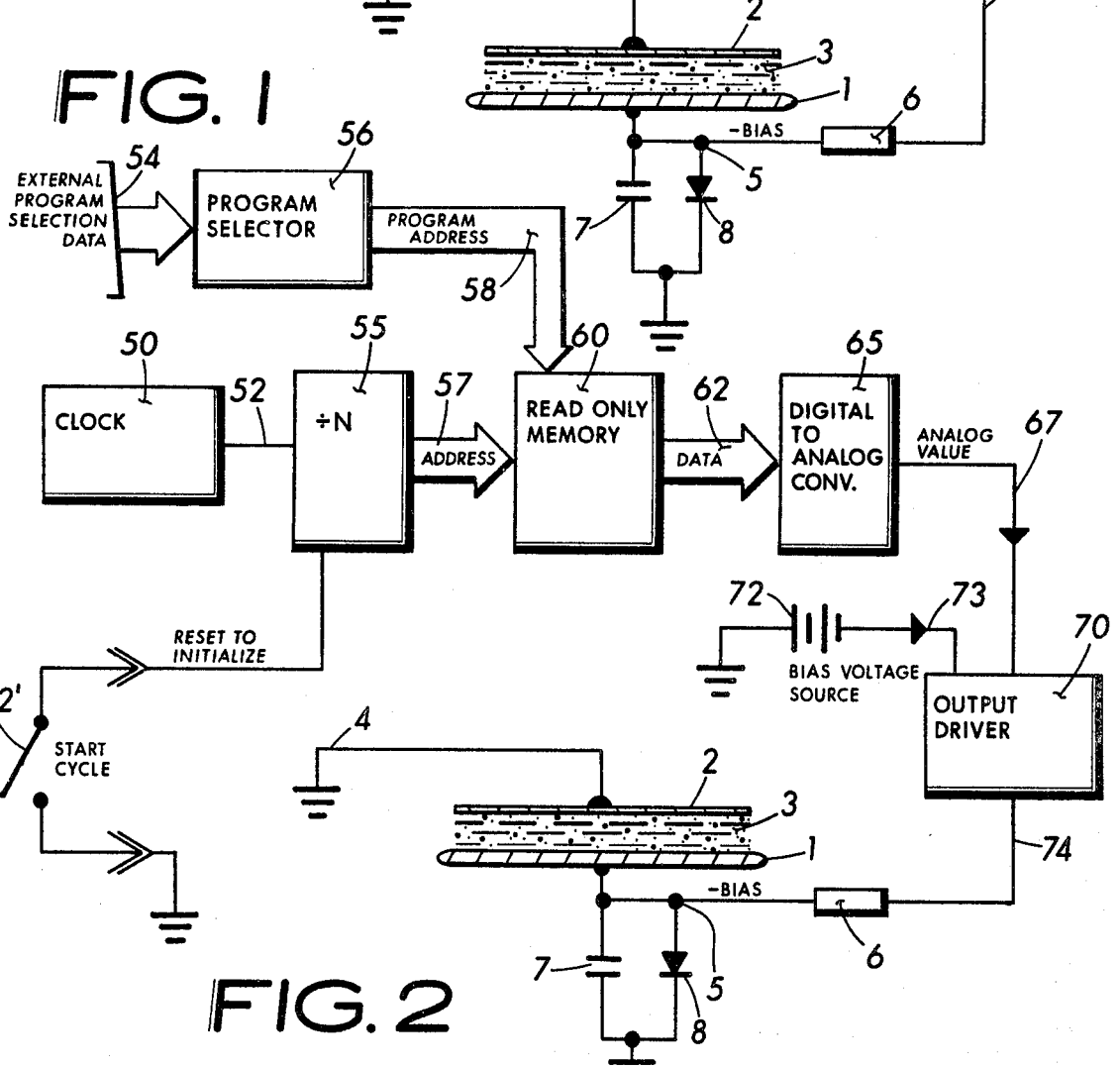
FIG. 2 The essence of the invention, including a digital logic controlled rate-of-change function generation is shown.

Yet another arrangement for attaining the invention's objectives appears in FIG. 2. This approach is digital, in comparison to the foregoing FIG. 1 which is essentially analog. A source of clock pulses 50 produces a pulse train 52 coupled to a ÷N counter 55. The clock pulse periodicity is predetermined to be of about such periodicity that about N pulses appear for the frame of time which is dedicated to the image toning step in the attendant electrostatic image forming apparatus. The binary format signal 57 produced by the counter addresses the various cells of a read-only-memory (ROM) which has been reprogrammed with a sequence of cell states which equate with the typical decay curve associated with the electrophotographic medium. These addressed memory cell states produce a multibit data signal 62 which serves to address a digital to analog converter 65, producing an output 67 therefrom having an instantaneous quasi analog value proportional to the input data byte weight. This analog value couples with the output driver 70, effectively modulating the bias source 72 electric value 73 also coupled thereto. The resulting variant dynamic bias output 74 couples through a limiting resistor 6 with the electrophotographic bias plate electrode 1. Also shown is a "start cycle" switch, or control, function 22' which acts to RESET, or initialize the counter 55 prior to bias generation.

The read-only memory is also shown to have yet another, program address 58, input. This is usually a most significant bit level binary signal which serves to "move" the sequentially addressed memory positions between different bias control program combinations. This ability to select "different" programs gives the overall electrophotographic camera or like apparatus the capability for working with photoconductors having different requirements for optimum dynamic bias, for unique toner combinations having finitely different preferred bias voltage, and other parameters which serve to affect the optimum slope for the dynamic bias values. These external program selection data signals are externally developed, coupling 54 with the program selector 56 to deveop the program address byte signal 58.

Figure 3:
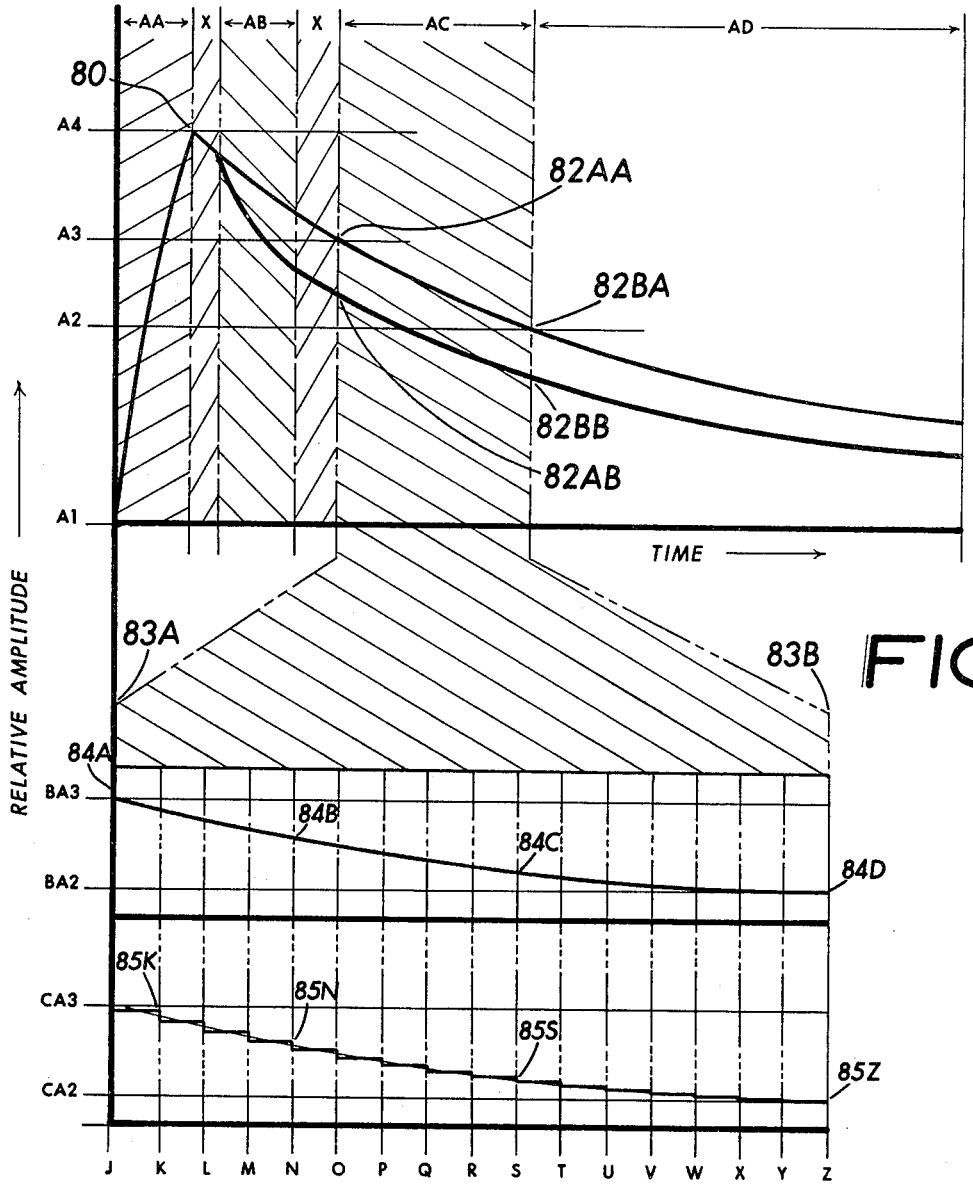
FIG. 3 Diagrammatic plots showing relationship between typical photoconductor natural charge decay phenomenon and the locally synthesized dynamic bias signal.

The graphic depictation of FIG. 3 illustrates the general signal values attendant with the instant invention. The upper curve of FIG. 3 shows the usual dynamic curve associated with a typical electrophotographic medium, such as that taught by U.S. Pat. No. 4,025,339. Time period AA is when corona charging is allowed and the medium surface potential increases from a low level A1 of essentially zero volts, to a "fully charged" level A4. The cessation of charge shows an abrupt reversal of the curve 80 as steady, albeit slow intrinsic discharge starts. A brief intercycle time frame X is shown just before the time usually allowed for "exposure." In the representative curve both an ensuing "non-exposed" and "partially exposed" curve continuation is shown. With no exposing, the electric charge value gradually decreases through the "expose" time frame, the next intercycle period X' until a value 82AA is reached at the onset of the allocated image "toning" time frame AC. During toning the effective charge still gradually descends to a lower value 82BA at the time frame AC end, whereupon it enters the "don't care" after-cycle period AD, eventually discharging to near zero. When some exposure occurs during time frame AB, the charge will be proportionately lowered to a somewhat lesser value 82AB at the onset of the toning time frame AC, descending therefrom to a yet lower value 82BB with time. In both illustrative examples, the rate of change during the time frame AC is about that of part of an exponential curve. Looking further down on FIG. 3, the time frame AC is expanded between the limits 83A to 83B. That curve described by the legends 84A, 84B, 84C, 84D corresponds with an analog derived curve which is produced by the teaching associated with FIG. 1, whilst that curve described by the legends 85K, 85N, 85S, 85Z corresponds with a quasi-analog, step-like curve produced by the teaching associated with FIG. 2. The artisian will clearly note the correlation between the various values, e.g. 84B, 84C, etc., and the equivalent values 85N, 85S, etc., in the two curves. The values of the curves between BA2 and BA3; and the values between CA2 and CA3 correspond in shape proportion, although not necessarily value, with the curve found between A2 and A3 on the uppermost curve of FIG. 3.

Figure 4:
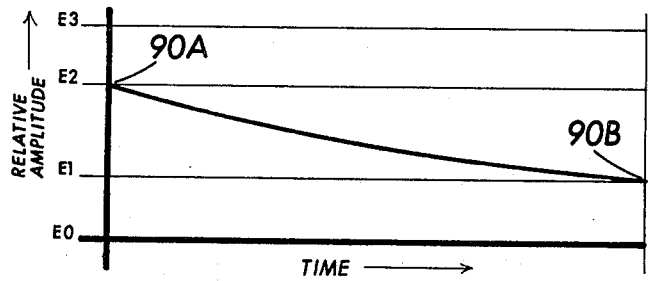
FIG. 4 Plot showing dynamic bias curve derived from capacitor discharge (or charge).

The FIG. 4 curve shows how the upper limit, e.g. maximum level 90A and lower limit, e.g. minimum level 90B, is established between bounds E2 and E1 respectively, where E2 is the desired initial toning bias value, and E1 is the "corrected" bias value desired due to some continued discharge of the electrophotographic medium charge.

Figure 5:
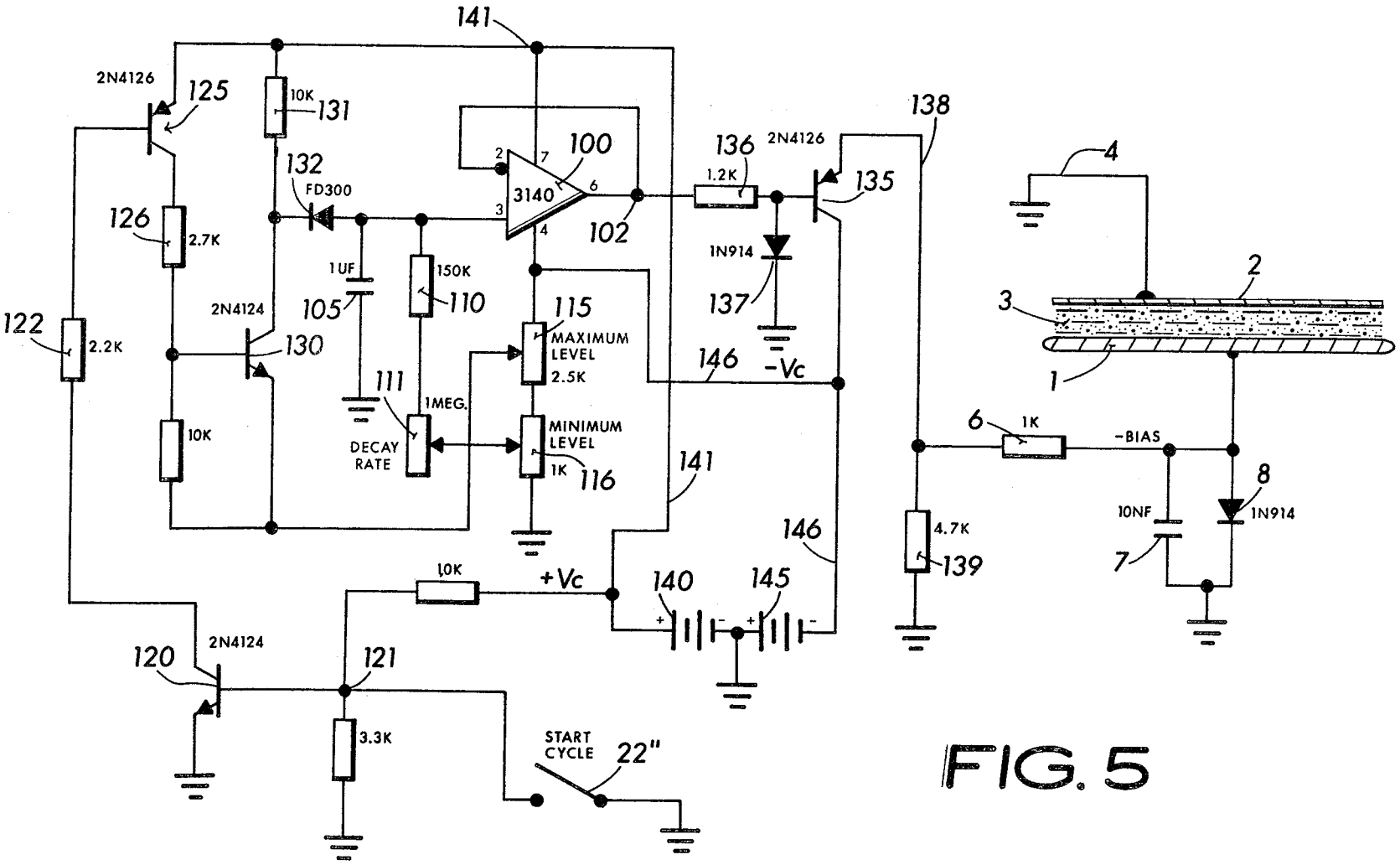
FIG. 5 Electrical diagram for an analog function generator based essentially on the discharge of a capacitor by parallel resistance.

A particular embodiment for an analog-derived bias is shown in FIG. 5. The heart of the function generation is the exponential discharge of the capacitor 105, which is buffered by an operational amplifier 100, such as a CA3140. With the "start cycle" switch 22'' open transistor 120 will saturate by virtue of base current introduced through the 10K resistor from $+V_C$. This will also cause transistor 125 to saturate, which acts as a level-shifting stage coupled to transistor 130 through resistor 126. The NPN transistor 130 has the emitter tied to a value intermediate between $-V_C$ and ground, set to determine the "maximum level" by potentiometer 115. When transistor 130 turns on, this intermediate $-V_C$ value will charge the capacitor 105 negative via diode 132. In accord the intermediate $-V_C$ value appearing across the capacitor 105 couples with the buffering operational amplifier 100, producing a replica value at the output 102 therefrom. This value couples through resistor 136 to PNP transistor 135 acting as an emitter follower, providing some of the $-V_C$ value on line 146 as a finite bias value on line 138, which in turn couples across a swamping resistor 139 to the limiting resistor 6 and thereon to the bias plate 1.

When the switch 22'' is closed, the dynamic bias cycle starts. In sequence, transistors 120, 125 and 130 will be cut off, non-conductive. Resistor 131 pulls the collector of transistor 130 positive, reverse biasing the low leakage disconnect diode 132. The result is the previous negative charge on the capacitor 105 will slowly and exponentially discharge positive toward ground through the resistor combination 110, 111 with the rheostat resistor 111 establishing the "decay rate." Discharge will continue until a lesser negative, near ground level is reached as established by the potentiometer 116. The resulting capacitor 105 negative potential decay will couple in near replicate form through the operational amplifier and the emitter follower to produce a dynamic, value/time variant bias voltage on the bias plate 1.

Figure 6:
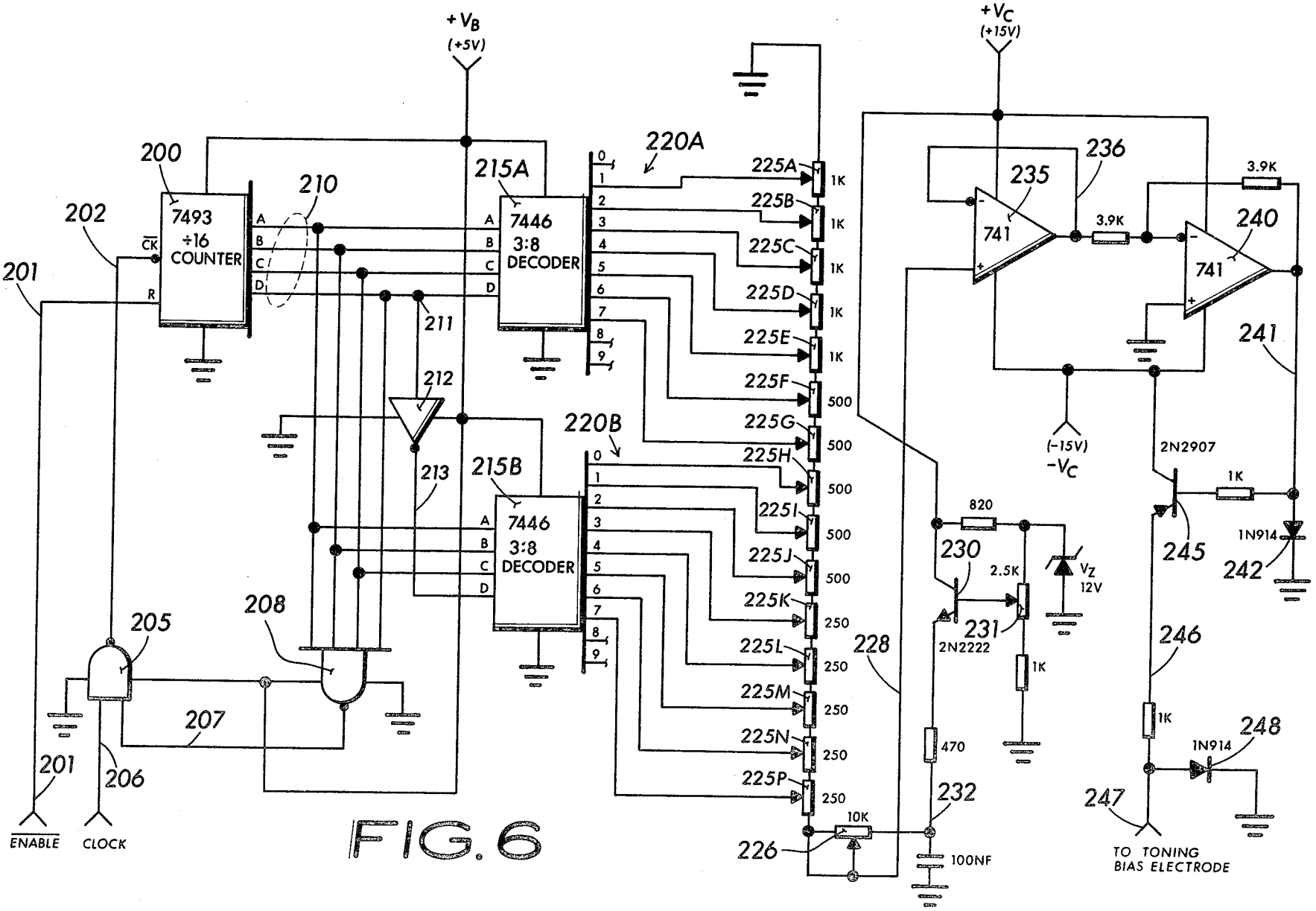
FIG. 6 Electrical diagram for a digital-to-analog function generator providing for diversity of the function curve slope adjustment.

The practiced implementation for a digitally controlled dynamic bias controller appears in FIG. 6. A source of clock pulses having a recurrence rate $F_{CK}$ about equal to $$F_{CK}=(T_t/16$$

where $T_t$ represents the total toning time frame couples 206 into NAND gate 205. A logic Low "enable" signal starts the dynamic bias function. When enabled, the ÷16 counter 200 receives clock pulses 202 which sequentially advances it through its states. The four outputs 210 couple with decoder 215A. Furthermore, the three A, B, C outputs 210 couple with decoder 215B whilst the D output 211 is inverted 212 and coupled 213 with the decoder 215B. The result is a serial sequence of decoded outputs 220A, 220B. These outputs couple with the arms of the voltage divider elements 225A through 225P as shown. These resistor elements, in combination with potentiometer 226, act to produce a variant voltage at the juncture of potentiometers 225P and 226 which couples 228 with the buffer amplifier 235. The output therefrom 236 couples with a level shifting amplifier 240 which adapts the positive polarity waveform so generated into a complimentary negative polarity waveform at the output 241. This level couples with emitter follower 245, together with clamp diode 242, producing therefrom a negative variant voltage, e.g. dynamic bias, which appears across the clamp diode 248 and terminates 247 to the earlier described bias plate 1. Through the judicious adjustment of the plural voltage divider taps 225A through 225P a wide range of "decay" waveforms may be simulated, giving great flexibility in the output waveform, particularly if a decay other than exponential is desired. The potentiometer 226 acts to set the minimum level, while potentiometer 231 together with emitter follower 230 acts to set the maximum level.

The invention also anticipates the provision of external signal values which particularly coact with the maximum level 12 and minimum level 13 control adjustments of FIG. 1. These signal values are derived through "looking back" in time to a preceding toning event and deriving therefrom the actual value of the resident medium charge at the start of the prior toning cycle and utilizing that value to predetermine the maximum initial bias level of the instant cycle. Furthermore, the decayed to remaining resident medium charge at the completion of the prior toning cycle is established and is utilized to predetermine the minimum bias level at the completion of the instant cycle. It is contemplated that, when such prior toning event occurs very shortly before the instant toning event, the prior resident charge values may be reasonably held as substantially analog values, as the charge in a very low leakage capacitor or the like, in the manner of "sample and hold" which is well understood art. Conversely, when the prior toning event occurs some substantial time previous to the instant event, or where individual toning events occur with sporadic regularity, the earlier resident charge values are contemplated to be connected into bytes of binary data, the weight of which represents the resident charge value. These binary bytes are then preferably stored in a random access memory (RAM) or the like, for convenient retrieval as needed.

It will be understood that certain features and subcombinations are of utility and may be employed without reference to other features and subcombinations. This is contemplated by and is within the scope of my claims. It is further obvious that various change may be made in details within the scope of my claims without departing from the spirit of my invention. It is, therefore, to be understood that my invention is not to be limited to the specific details as shown and described.

What is claimed is:

1. Electric toning bias method for effecting a time related dynamic change in value of the electric field lines produced interactively between a bias electrode, a toner medium, and an electrophotographic imaging medium, whereby:

a. a first electric bias value is predetermined which is about optimum for the instant in time wherein the interactive toning effect commences;

b. a second electric bias value is predetermined which is about optimum for the instant in time wherein the interactive toning effect desists;

c. a time related rate-of-change function is predetermined which simulates the slope of the natural time related decay of the electric charge resident with the photoconductor substance comprising the essence of the electrophotograhic medium;

adaptive control of the electric toning bias value, effecting a dynamic time related change between the said first electric bias value and the second electric bias value which is momentarily about in proportion with the said slope of the said rate-of-change function.

2. Electric toning bias method of claim 1 wherein said rate-of-change function is about exponential.

3. Electric toning bias method of claim 1 wherein said rate-of-change function is a synthesized function comprised of a finite plurality of time-dependent steps each having a substantially separate electric value, the sequential summation of which describes the said rate-of-change function.

4. Electric toning bias means effective to produce a time related dynamic change in the electric field lines produced interactively between a bias electrode, a toner medium, and an electrophotographic image medium, including in combination therefor:

a. a source of electric bias potential;

b. a control means having a first input thereto coupled with said source, a second input thereto for receiving a control signal, and an output therefrom which is proportionately equal to the potential value of the source effectively modulated relative to the instant value of the said control signal;

c. rate-of-change function source coupled with said control means second input and effective to produce a dynamic electric control signal having a predetermined time related change in sequentially instant values which substantially simulates the change in resident charge of the photoconductor comprising the said electrophotographic image medium, as wrought by the natural decay thereof; and, d. coupling means effective to adapt the modulated output of the said control means with the said bias electrode.

5. Bias means of claim 4 wherein said electric bias potential is substantially of negative polarity.

6. Bias means of claim 4 wherein said electric bias potential is substantially of positive polarity.

7. Bias means of claim 4 wherein said electric bias potential is of substantially alternating polarity and whereby further the effective peak-to-peak value is decremented.

8. Bias means of claim 4 wherein said rate-of-change function is about linear relative to the toning time period.

9. Bias means of claim 4 wherein said rate-of-change function is about exponential relative to the toning time period.

10. Bias means of claim 4 wherein said rate-of-change function is essentially derived from the accumulated potential discharge characteristic across a charged electric capacitor parallel with a fixed resistance.

11. Bias means of claim 4 wherein said rate-of-change function is essentially derived from the accumulated potential charge characteristic across a discharged electric capacitor in series with a fixed resistance and a source of electric charge potential.

12. Bias means of claim 4 wherein said rate-of-change function is substantially a series of time dependent binary states, each having an instant binary weight which is adapted to produce a finite electric potential value therefrom, the sequential summation of which about describes the requisite rate-of-change function.

13. Bias means of claim 4 wherein said rate-of-change function is effectively produced by a digital-to-analog converter (DAC) means; said DAC having a digital input thereto for receiving seriate bytes of binary data from a digital memory having a predetermined program stored therein which best describes the desired rate-of-change function, whereby said memory is sequentially addressed through its predetermined stored program during the effective toning time period; and further the DAC providing a substantially analog, albeit finitely stepped, output therefrom effectively coupled with the said control means said second input.

14. Bias means of claim 13 wherein said memory comprises at least part of an overall memory function inherent with the central processing unit (CPU) logic intrinsic with an overall electrophotographic image producing apparatus digital logic embodied control system.

15. Bias means of claim 4 wherein said rate-of-change function includes a level input thereto which represents the value of the resident charge of the photoconductor approximately instant with the start of the toning time period.

16. Bias means of claim 15 wherein the resident charge level coupled with the said level input serves to combine with the rate-of-change function determining means to modify the sequential value changes thereof, thereby producing a control signal having time related changes in value which best reflect the natural decay character of the photoconductor, for any value of initial toning time period resident charge.

17. Bias means of claim 13 wherein said digital memory further includes program address means which acts to shift the content of sequentially addressed memory states between several predetermined stored programs.

18. Bias means of claim 17 wherein said program address is established at least by the electrophotographic imaging medium's predetermined natural decay characteristic.

19. Bias means of claim 17 wherein said program address is established at least by the toner medium's predetermined characeristic for providing optimum toning effect.

20. Bias means of claim 17 wherein said program address is established at least by the value of the resident electric charge intrinsic with the photoconductor, coincident with the start of the toning time period.

21. Bias means of claim 4 whereby the maximum rate-of-change function value is predetermined by the effective initial resident charge of the photoconductor at the onset of a preceding toning time period.

22. Bias means of claim 4 whereby the minimum rate-of-change function value is predetermined by the effective remaining resident charge of the photoconductor at the completion of a preceding toning time period.

23. Bias means of claim 4 whereby the decay rate of the rate-of-change function value is predetermined as a derivative of the difference between the effective initial resident charge of the photoconductor at the onset of a preceding toning time period and the effective remaining resident charge of the photoconductor at the completion of usually the same preceding toning time period.

24. Bias means of claim 21 wherein said initial resident charge at the onset of a preceding toning time period is converted into a digital byte signal and stored in a binary memory means for retrieval effectively prior to the onset of a subsequent toning cycle, where it is adapted to control the initial value of the dynamic bias.

25. Bias means of claim 22 wherein said initial resident charge at the completion of preceding toning time period is converted into a digital byte signal and stored in a binary memory means for retrieval effectively prior to the completion of a subsequent toning cycle, where it is adapted to control the value of the dynamic bias upon completion of effective toning.

26. Bias means of claim 23 wherein said initial resident charge and remaining resident charge of said preceding toning time period are converted into digital byte signals and stored in a binary memory for retrieval therefrom during a subsequent toning time period, effective to be adapted into a dynamic bias value therefor.

* * * * *